US010626474B2

(12) United States Patent
Shingaki et al.

(10) Patent No.: US 10,626,474 B2
(45) Date of Patent: Apr. 21, 2020

(54) GRAIN-ORIENTED ELECTRICAL STEEL SHEET AND METHOD OF MANUFACTURING SAME

(71) Applicant: JFE STEEL CORPORATION, Chiyoda-ku, Tokyo (JP)

(72) Inventors: Yukihiro Shingaki, Tokyo (JP); Tomoyuki Okubo, Tokyo (JP); Hirotaka Inoue, Tokyo (JP)

(73) Assignee: JFE STEEL CORPORATION, Chiyoda-ku, Tokyo (JP)

( * ) Notice: Subject to any disclaimer, the term of this patent is extended or adjusted under 35 U.S.C. 154(b) by 302 days.

(21) Appl. No.: 15/538,800

(22) PCT Filed: Dec. 24, 2015

(86) PCT No.: PCT/JP2015/086588
§ 371 (c)(1),
(2) Date: Jun. 22, 2017

(87) PCT Pub. No.: WO2016/104813
PCT Pub. Date: Jun. 30, 2016

(65) Prior Publication Data

US 2018/0002773 A1 Jan. 4, 2018

(30) Foreign Application Priority Data

Dec. 24, 2014 (JP) ..... 2014-260770

(51) Int. Cl.
*C21D 9/46* (2006.01)
*C21D 8/12* (2006.01)
(Continued)

(52) U.S. Cl.
CPC ..... *C21D 8/1288* (2013.01); *C21D 8/1272* (2013.01); *C21D 8/1283* (2013.01);
(Continued)

(58) Field of Classification Search
CPC .. C21D 8/1222; C21D 8/1233; C21D 8/1283; C21D 8/1288; C21D 9/46; C22C 38/00;
(Continued)

(56) References Cited

U.S. PATENT DOCUMENTS 4,698,272 A * 10/1987 Inokuti ..... C21D 8/1277 148/308

FOREIGN PATENT DOCUMENTS

EP 0959142 A2 11/1999
JP S621820 A 1/1987
(Continued)

OTHER PUBLICATIONS

NPL: On-line translation of JP2001295062A Oct. 2001 (Year: 2001).*
(Continued)

*Primary Examiner* — Jie Yang
(74) *Attorney, Agent, or Firm* — Kenja IP Law PC

(57) ABSTRACT

A grain-oriented electrical steel sheet that includes a base coating with a high TiN ratio advantageous for the application of tension to the steel sheet and has excellent magnetic property is provided. The grain-oriented electrical steel sheet includes: a base coating having a peak value PTiN of TiN in the form of osbornite, observed in a range of $42°<2\theta<43°$ and a peak value $PMg_2SiO_4$ of $Mg_2SiO_4$ in the form of forsterite, observed in a range of $35°<2\theta<36°$ of both more than 0 and satisfying a relationship $PTiN \geq PMg_2SiO_4$, in thin-film X-ray diffraction analysis; and an iron loss $W_{17/50}$ of 1.0 W/kg or less.

5 Claims, 2 Drawing Sheets

(51) Int. Cl.

| | |
|---|---|
| ***C23C 8/26*** | (2006.01) |
| ***C22C 38/60*** | (2006.01) |
| ***H01F 1/16*** | (2006.01) |
| ***C22C 38/00*** | (2006.01) |
| ***C23C 8/50*** | (2006.01) |
| ***C22C 38/16*** | (2006.01) |
| ***C23C 8/02*** | (2006.01) |
| ***C22C 38/08*** | (2006.01) |
| ***C22C 38/14*** | (2006.01) |
| ***C22C 38/12*** | (2006.01) |
| ***C22C 38/18*** | (2006.01) |
| ***C23C 8/80*** | (2006.01) |
| ***C22C 38/02*** | (2006.01) |
| ***C22C 38/04*** | (2006.01) |
| ***C22C 38/06*** | (2006.01) |

(52) U.S. Cl.

CPC ..... *C21D 9/46* (2013.01); *C22C 38/00* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/60* (2013.01); *C23C 8/02* (2013.01); *C23C 8/26* (2013.01); *C23C 8/50* (2013.01); *C23C 8/80* (2013.01); *H01F 1/16* (2013.01); *C21D 8/1222* (2013.01); *C21D 8/1233* (2013.01); *C21D 8/1255* (2013.01)

(58) Field of Classification Search

CPC .... C23C 8/02; C23C 8/26; C23C 8/50; C23C 8/80; H01F 1/16

USPC ..... 148/307

See application file for complete search history.

(56) References Cited

FOREIGN PATENT DOCUMENTS

| | | | |
|---|---|---|---|
| JP | S6354767 | A | 3/1988 |
| JP | H06179977 | A | 6/1994 |
| JP | H08291390 | A | 11/1996 |
| JP | 2984195 | B2 | 11/1999 |
| JP | 2000109931 | A | 4/2000 |
| JP | 2001295062 | A | 10/2001 |
| JP | 3357611 | B2 | 12/2002 |
| JP | 2009270129 | A | 11/2009 |

OTHER PUBLICATIONS

NPL: On-line translation of JPH08291390A Nov. 1996 (Year: 1996).*

Dec. 4, 2017, the Extended European Search Report issued by the European Patent Office in the corresponding European Patent Application No. 15873381.6.

Sep. 3, 2018, Office Action issued by the Korean Intellectual Property Office in the corresponding Korean Patent Application No. 10-2017-7017810 with English language Concise Statement of Relevance.

Sep. 5, 2017, Notification of Reasons for Refusal issued by the Japan Patent Office in the corresponding Japanese Patent Application No. 2016-566585 with English language concise statement of relevance.

Apr. 5, 2016, International Search Report issued in the International Patent Application No. PCT/JP2015/086588.

Yukio Inokuti et al., "Grain Oriented Silicon Steel Sheet with Ceramic Films Characterized by Ultra-Low Iron Loss", Journal of the Japan Institute of Metals, 1992, vol. 56, No. 12, pp. 1428-1434.

* cited by examiner

GRAIN-ORIENTED ELECTRICAL STEEL SHEET AND METHOD OF MANUFACTURING SAME

TECHNICAL FIELD

The disclosure relates to a grain-oriented electrical steel sheet including a high tension coating and having excellent magnetic property, and a method of manufacturing the grain-oriented electrical steel sheet at low cost.

BACKGROUND

A grain-oriented electrical steel sheet is a soft magnetic material mainly used as an iron core material of a transformer or generator, and has crystal texture in which <001> orientation which is the easy magnetization axis of iron is highly accumulated into the rolling direction of the steel sheet. Such texture is formed through secondary recrystallization of preferentially causing the growth of giant crystal grains in (110)[001] orientation which is called Goss orientation, when secondary recrystallization annealing (final annealing) is performed in the process of manufacturing the grain-oriented electrical steel sheet.

A conventional procedure for manufacturing such a grain-oriented electrical steel sheet is as follows. A slab containing about 4.5 mass % or less Si and an inhibitor component such as MnS, MnSe, and MN is heated to 1300° C. or more to dissolve the inhibitor component. The slab is then hot rolled to obtain a hot rolled sheet. The hot rolled sheet is optionally hot band annealed. The hot rolled sheet is then cold rolled once, or twice or more with intermediate annealing therebetween, to obtain a cold rolled sheet having a final sheet thickness. The cold rolled sheet is then subjected to primary recrystallization annealing in a wet hydrogen atmosphere, thus forming a primary recrystallization annealed sheet that has undergone primary recrystallization and decarburization. After this, an annealing separator having magnesia (MgO) as a main ingredient is applied to the primary recrystallization annealed sheet, and then final annealing is performed at 1200° C. for about 5 h to develop secondary recrystallization and purify the inhibitor component.

A coating is formed on the surface of such a grain-oriented electrical steel sheet to impart insulation property, workability, rust resistance, and the like. The surface coating is typically composed of a base coating mainly made of forsterite and formed during final annealing and a phosphate-based top coating formed on the base coating. These coatings are formed at high temperature and have a low coefficient of thermal (heat) expansion, and so have an effect of reducing iron loss by applying tension to the steel sheet from the difference in coefficient of thermal expansion between the steel sheet and the coating when decreased to ambient temperature.

This effect is greater when the tension is higher. It is therefore desirable to apply as high tension as possible to the steel sheet. High tension also has an effect of reducing sensitivity to external work or stress (degradation in magnetic property, mainly iron loss, caused by compression, degradation in magnetostrictive property, and degradation in noise property when using the steel sheet as an iron core of a transformer). Thus, the formation of the coating that can apply high tension to the steel sheet is important not only for the improvement in iron loss property but also for other purposes.

Various coatings have been conventionally proposed to satisfy such properties. Journal of the Japan Institute of Metals, Vol. 56, No. 12 (1992), pp. 1428-1434 (NPL 1) describes that the use of ceramic such as TiN with a lower coefficient of thermal expansion to obtain higher tension than a forsterite coating or a phosphate coating improves magnetic property significantly.

JP 2984195 B2 (PTL 1) reports that a coating having high tension property can be formed by containing an appropriate amount of TiN in a forsterite coating. To form a coating having higher tension property, a coating with a higher TiN ratio and a method of manufacturing such a coating are needed. As a method of using pure TiN as the base coating of the grain-oriented electrical steel sheet, the use of chemical or physical vapor deposition has been proposed (for example, JP S63-54767 B2 (PTL 2)). However, industrially implementing this requires a very special facility, causing a significant increase in manufacturing cost.

CITATION LIST

Patent Literatures

PTL 1: JP 2984195 B2
PTL 2: JP S63-54767 B2

Non-Patent Literature

NPL 1: Journal of the Japan Institute of Metals, Vol. 56, No. 12 (1992), pp. 1428-1434

SUMMARY

Technical Problem

As mentioned above, although the iron loss of the grain-oriented electrical steel sheet is effectively improved by forming such a coating that can apply high tension to the steel sheet, coating the steel sheet with ceramic such as TiN much lower in coefficient of thermal expansion than the conventional coatings requires high manufacturing cost and a special facility.

We accordingly considered the possibility of forming TiN by using thermal energy during nitriding and final annealing in the process of manufacturing the grain-oriented electrical steel sheet, without adding a special step. As a result of intensive study, we made new discoveries.

It could be helpful to provide a grain-oriented electrical steel sheet that includes a base coating with a high TiN ratio advantageous for the application of tension to the steel sheet and has excellent magnetic property, and a method of manufacturing such a grain-oriented electrical steel sheet without substantially adding another step.

Solution to Problem

We first studied the following mechanism to form a TiN coating during final annealing and, based on a verification experiment described below, made new discoveries. The grain-oriented electrical steel sheet is typically final annealed using a high temperature of 1100° C. or more and a hydrogen atmosphere. Various metal oxides are reduced when annealed in a high-temperature hydrogen atmosphere. Meanwhile, it is known that, although the grain-oriented electrical steel sheet that has undergone nitriding treatment has a large amount of nitrogen in the steel, nitrogen is discharged out of the system during the subsequent final annealing, and so the amount of nitrogen in the steel has decreased significantly after the final annealing.

Hence, there is a possibility that, for example if $TiO_2$ is added to the annealing separator, $TiO_2$ is reduced and decomposed in the hydrogen atmosphere to form metal Ti, and nitrogen which is supposed to be discharged out of the system by purification is, for its high affinity for metal Ti, trapped by Ti to form TiN.

(Verification Experiment)

A steel slab having a chemical composition containing C: 0.04 mass %, Si: 3.0 mass %, Mn: 0.05 mass %, S: 0.005 mass %, Sb: 0.01 mass %, Al: 60 mass ppm, and N: 30 mass ppm with a balance being Fe and incidental impurities was heated at 1230° C., and hot rolled into a hot rolled coil of 2.0 mm in thickness. The hot rolled coil was hot band annealed at 1030° C., and further cold rolled to satisfy an aging time of 1 minute or more at 200° C. during rolling, into a cold rolled sheet of 0.30 mm in thickness. The cold rolled sheet was subjected to primary recrystallization annealing that also serves as decarburization annealing, in a wet hydrogen-nitrogen mixed atmosphere of 800° C.

250 test pieces of 30 mm in width and 300 mm in length were cut out of the obtained decarburization annealed coil. 50 test pieces were not subjected to nitriding treatment. The remaining 200 test pieces were, in units of 50 test pieces, subjected to nitriding treatment of four levels of 2 minutes to 10 minutes at 500° C. in an $NH_3$ gas atmosphere. The amount of nitrogen in the steel after the nitriding was 30 mass ppm in the test pieces not subjected to the nitriding treatment, and 220 mass ppm, 515 mass ppm, 790 mass ppm, and 1010 mass ppm in the test pieces subjected to the respective four levels of nitriding treatment.

$TiO_2$ was mixed in the proportion of 5 g with 100 g of an annealing separator having MgO as a main ingredient, and also an alkaline earth metal hydroxide was added in the proportion of 3 g to 100 g of the annealing separator. The annealing separator was then hydrated and made into slurry. The slurry was applied to each test piece so that the coating amount was 10 g/$m^2$ in the finally baked and dried state (the contained Ti compound was 0.28 g/$m^2$ in Ti mass equivalent).

The 50 test pieces of each nitrogen level were stacked so that each set was made up of 10 test pieces, to form five laminates of the level having the same amount of nitrogen in the steel. These five laminates were subjected to soaking annealing of 30 hours at the respective temperatures of 780° C., 830° C., 880° C., 930° C., and 980° C. in a nitrogen-argon mixed atmosphere ($PH_2O/PH_2=\infty$). After this, the laminates were subjected to soaking treatment of 5 hours at 1220° C., for the formation of TiN and the purification of nitrogen in the steel. Here, once the furnace temperature had exceeded 1050° C., the furnace atmosphere was changed to hydrogen, and the hydrogen atmosphere was maintained until the end of the soaking. After the soaking, the atmosphere was set to a nitrogen atmosphere, and cooling was carried out by furnace cooling.

After removing the residual annealing separator in each laminate after the final annealing, its surface appearance was observed. The right photograph (Example) in FIG. 1 shows the appearance of a sample with the amount of nitrogen in the steel after the nitriding of 220 mass ppm and the soaking temperature of 880° C., where a coating of somewhat dull gold color was formed.

A thin-film X-ray diffractometer (RINT1500 made by Rigaku, Cu source) was used to generate X-rays under the condition of 50 kV and 250 mA, and each sample was submitted to 2θ measurement and evaluated. FIG. 2 illustrates the result of the Example shown in the right photograph in FIG. 1.

In the drawing, the peak value observed in the range of $42°<2\theta<43°$ was highest of the peaks indicating TiN. Let this peak value be PTiN. All peaks indicating forsterite were lower than PTiN. A peak indicating forsterite that does not overlap in peak position with TiN was observed in the range of $35°<2\theta<36°$. Let this peak value be $PMg_2SiO_4$. $PMg_2SiO_4$ was about ⅔ of PTiN in strength. FIG. 3 illustrates the range where PTiN $PMg_2SiO_4$ was obtained in the verification experiment. In the drawing, each condition resulting in $PTiN \geq PMg_2SiO_4 \times 1.3$ was designated by a circle, each condition resulting in $PMg_2SiO_4 \times 1.3 \geq PTiN \geq PMg_2SiO_4$ by a triangle, and each condition resulting in $PTiN < PMg_2SiO_4$ by a cross. In each sample where $PTiN \geq PMg_2SiO_4$, a coating of somewhat dull gold color was formed as in the right photograph in FIG. 1.

The left photograph (Comparative Example) in FIG. 1 shows the appearance of a sample with the amount of nitrogen in the steel after the nitriding of 30 mass ppm and the soaking temperature of 880° C., where a gold coating was not seen. The X-ray diffraction result of this Comparative Example was $PTiN < PMg_2SiO_4$.

A coating on one side of each of the test piece of $PTiN \geq PMg_2SiO_4$ and the test piece of the Comparative Example was removed, and their magnitudes of deflection were compared. As a result, the magnitude of deflection of the test piece of $PTiN \geq PMg_2SiO_4$ was about twice that of the test piece of the Comparative Example. Moreover, the test piece of $PTiN \geq PMg_2SiO_4$ had a larger magnitude of deflection than the test piece of $PTiN < PMg_2SiO_4$. The magnitude of deflection of the steel sheet when removing the coating on one side of the test piece serves as an index for quantitatively evaluating the tension applied to the steel sheet by the coating.

Based on the experiment described above, we discovered that a base coating satisfying $PTiN \geq PMg_2SiO_4$ can apply high tension to the steel sheet, and also found such a manufacturing condition that enables the formation of the coating satisfying $PTiN \geq PMg_2SiO_4$ during final annealing. In the case where the amount of nitrogen in the steel after the nitriding treatment was 1010 mass ppm, however, as a result of the inhibitor formed as secondary recrystallization inhibiting capability becoming too strong, even the test piece having the base coating satisfying $PTiN \geq PMg_2SiO_4$ had a secondary recrystallization failure, and was unable to obtain favorable magnetic property as its iron loss $W_{17/50}$ increased to more than 1.0 W/kg. The disclosure is based on the aforementioned discoveries and further studies.

We provide the following:

1. A grain-oriented electrical steel sheet comprising: a base coating having a peak value PTiN of TiN in the form of osbornite, observed in a range of $42°<2\theta<43°$ and a peak value $PSiO_2$ of $SiO_2$ in the form of cristobalite, observed in a range of $23°<2\theta<25°$ of both more than 0 and satisfying a relationship $PTiN \geq PSiO_2$, in thin-film X-ray diffraction analysis; and an iron loss $W_{17/50}$ of 1.0 W/kg or less.

2. A grain-oriented electrical steel sheet comprising: a base coating having a peak value PTiN of TiN in the form of osbornite, observed in a range of $42°<2\theta<43°$ and a peak value $PMg_2SiO_4$ of $Mg_2SiO_4$ in the form of forsterite, observed in a range of $35°<2\theta<36°$ of both more than 0 and satisfying a relationship $PTiN \geq PMg_2SiO_4$, in thin-film X-ray diffraction analysis; and an iron loss $W_{17/50}$ of 1.0 W/kg or less.

3. A method of manufacturing the grain-oriented electrical steel sheet according to 1. or 2., comprising: hot rolling a steel slab to obtain a hot rolled sheet, the steel slab having a chemical composition containing (consisting of), in mass %, C: 0.001% to 0.10%, Si: 1.0% to 5.0%, Mn: 0.01% to 0.5%, one or two selected from S and Se: 0.002% to 0.040% in total, sol.Al: 0.001% to 0.050%, and N: 0.0010% to 0.020%, with a balance being Fe and incidental impurities; optionally hot band annealing the hot rolled sheet; thereafter cold rolling the hot rolled sheet either once, or twice or more with intermediate annealing performed therebetween, to obtain a cold rolled sheet having a final sheet thickness; thereafter primary recrystallization annealing the cold rolled sheet, to obtain a primary recrystallization annealed sheet; performing nitriding treatment on the cold rolled sheet during the primary recrystallization annealing or on the primary recrystallization annealed sheet after the primary recrystallization annealing; and thereafter applying an annealing separator to the primary recrystallization annealed sheet after the nitriding treatment, and secondary recrystallization annealing the primary recrystallization annealed sheet, wherein an amount of nitrogen in steel after the nitriding treatment is 150 mass ppm or more and 1000 mass ppm or less, the annealing separator contains a Ti compound in a range of 0.10 g/m$^2$ or more and 1.5 g/m$^2$ or less in Ti mass equivalent, and in the secondary recrystallization annealing, soaking annealing of 20 hours or more is performed at a predetermined temperature of 800° C. to 950° C. in an oxidizing atmosphere of $PH_2O/PH_2$ of 0.05 or more, and then annealing of 5 hours or more is performed in a temperature range of 1000° C. or more in a $H_2$-containing atmosphere.

4. A method of manufacturing the grain-oriented electrical steel sheet according to 2., comprising: hot rolling a steel slab to obtain a hot rolled sheet, the steel slab having a chemical composition containing, in mass %, C: 0.001% to 0.10%, Si: 1.0% to 5.0%, Mn: 0.01% to 0.5%, one or two selected from S and Se: 0.002% to 0.040% in total, sol.Al: 0.001% to 0.050%, and N: 0.0010% to 0.020%, with a balance being Fe and incidental impurities; optionally hot band annealing the hot rolled sheet; thereafter cold rolling the hot rolled sheet either once, or twice or more with intermediate annealing performed therebetween, to obtain a cold rolled sheet having a final sheet thickness; thereafter primary recrystallization annealing the cold rolled sheet, to obtain a primary recrystallization annealed sheet; performing nitriding treatment on the cold rolled sheet during the primary recrystallization annealing or on the primary recrystallization annealed sheet after the primary recrystallization annealing; and thereafter applying an annealing separator to the primary recrystallization annealed sheet after the nitriding treatment, and secondary recrystallization annealing the primary recrystallization annealed sheet, wherein an amount of nitrogen in steel after the nitriding treatment is 150 mass ppm or more and 1000 mass ppm or less, the annealing separator contains MgO as a main ingredient, and contains Ti oxide or Ti silicide in a range of 0.10 g/m$^2$ or more and 1.5 g/m$^2$ or less in Ti mass equivalent, and in the secondary recrystallization annealing, soaking annealing of 20 hours or more is performed at a predetermined temperature of 800° C. to 950° C. in an oxidizing atmosphere of $PH_2O/PH_2$ of 0.05 or more, and then annealing of 5 hours or more is performed in a temperature range of 1000° C. or more in a $H_2$-containing atmosphere.

5. The method of manufacturing the grain-oriented electrical steel sheet according to 3. or 4., wherein the chemical composition of the steel slab further contains, in mass %, one or more selected from Ni: 0.005% to 1.50%, Sn: 0.01% to 0.50%, Sb: 0.005% to 0.50%, Cu: 0.01% to 0.50%, Cr: 0.01% to 1.50%, P: 0.0050% to 0.50%, Mo: 0.01% to 0.50%, Nb: 0.0005% to 0.0100%, Ti: 0.0005% to 0.0100%, B: 0.0001% to 0.0100%, and Bi: 0.0005% to 0.0100%.

Advantageous Effect

The grain-oriented electrical steel sheet according to the disclosure includes a base coating with a high TiN ratio advantageous for the application of tension to the steel sheet and has excellent magnetic property. Moreover, with the method of manufacturing a grain-oriented electrical steel sheet according to the disclosure, a base coating with a high TiN ratio advantageous for the application of tension to the steel sheet can be formed without substantially adding another step, so that a grain-oriented electrical steel sheet having excellent magnetic property is obtained.

DETAILED DESCRIPTION

Figure 1:
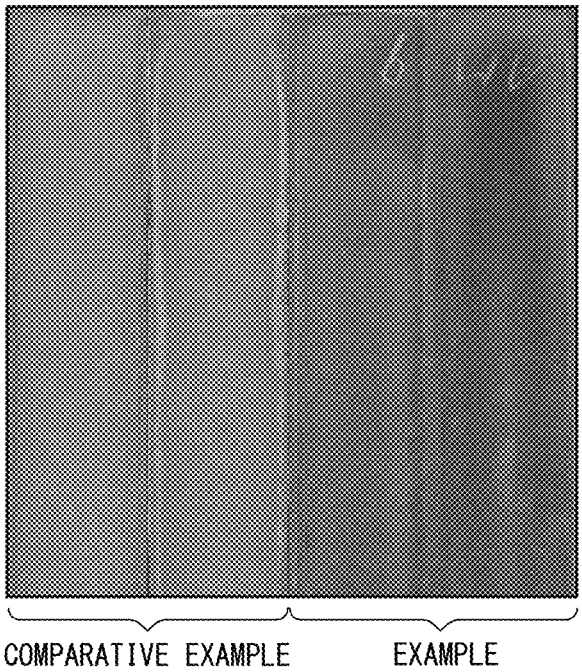
FIG. 1 is a photograph of the appearance of each steel sheet including a base coating different in TiN ratio obtained in a verification experiment.
Figure 2:
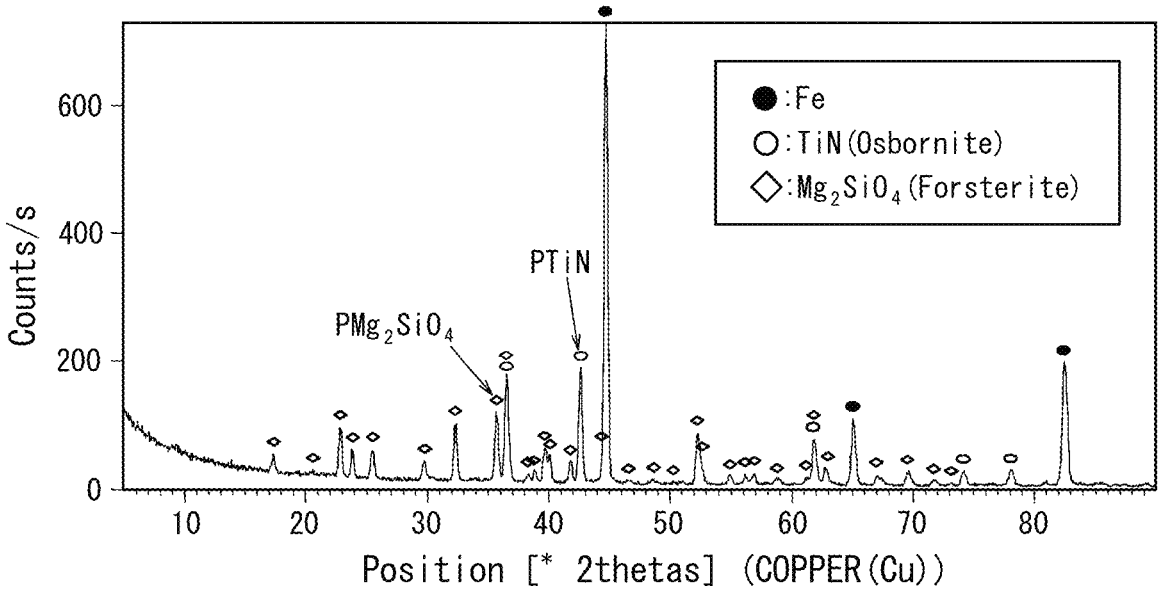
FIG. 2 is a graph illustrating the result of 2θ measurement on Example in FIG. 1 by generating X-rays under the condition of 50 kV and 250 mA using a thin-film X-ray diffractometer (RINT1500 made by Rigaku, Cu source)
Figure 3:
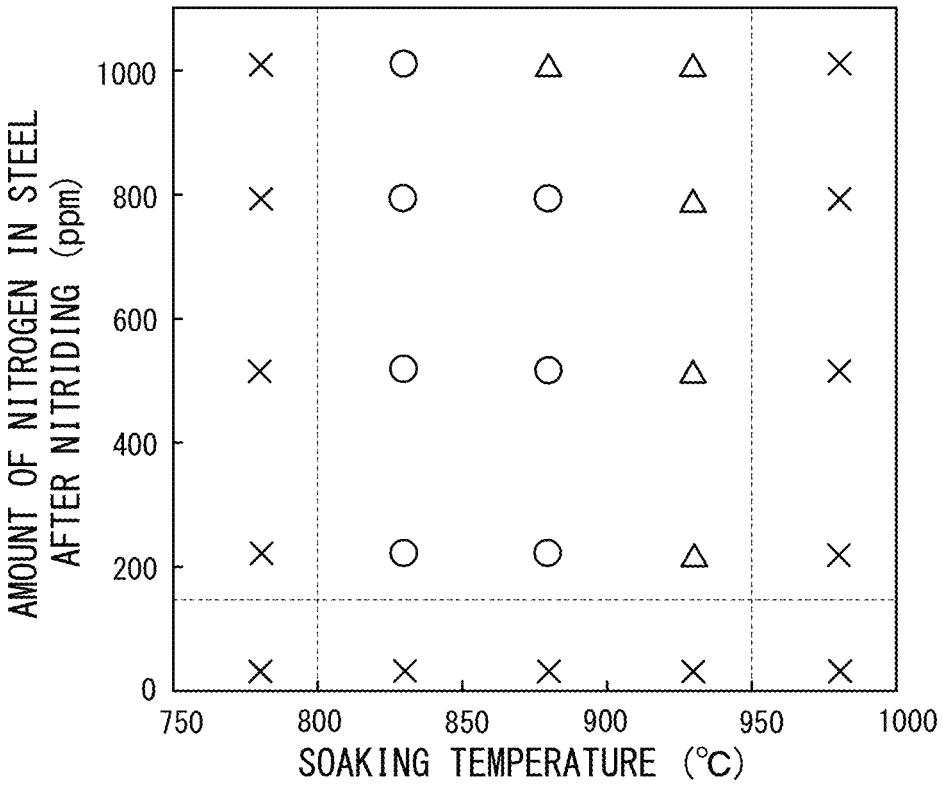
FIG. 3 is a diagram illustrating the range where $PTiN \geq PMg_2SiO_4$ was obtained in the verification experiment.

The disclosure basically relates to a grain-oriented electrical steel sheet in which a base coating with a high TiN ratio is formed to apply high tension to the steel sheet. Hence, in the method of manufacturing a grain-oriented electrical steel sheet according to the disclosure, typical conditions are suitably used as the manufacturing conditions other than the base coating formation method in particular, and there is no particular limitation except for the below-mentioned amount of nitrogen in the steel after nitriding treatment.

The disclosure is based on the discovery that the aforementioned base coating with a high TiN ratio can be formed by a new, non-conventional formation method, and proposes a manufacturing method therefor. Basically, any of the conventionally known electrical steel sheet manufacturing methods may be used up to decarburization annealing. Here, since a decarburization annealed sheet suitable for secondary recrystallization cannot be obtained if the steel slab composition is outside the below-mentioned range, there is a preferable range for the steel slab composition. The following describes the reasons for limiting the preferable range of each element in the steel slab and the grain-oriented electrical steel sheet. In the description of the chemical composition, "%" denotes "mass %" unless otherwise noted.

C: 0.001% to 0.10%

C is an element useful in improving primary recrystallized texture. If the C content is more than 0.10%, the primary recrystallized texture degrades. The C content is therefore preferably 0.10% or less. If C remains in the steel sheet after final annealing, magnetic degradation called magnetic aging occurs. Thus, a large amount of C leads to a greater decarburization annealing load. The C content is therefore more desirably 0.08% or less. Although the C content desirable in terms of texture improvement is 0.01% or more, in the case where the required level of magnetic property is not so high, the lower limit of the C content may be 0.001% in order to omit or simplify decarburization in primary recrystallization annealing.

Si: 1.0% to 5.0%

Si is an element useful in improving iron loss by increasing electrical resistance, and so the Si content is desirably 1.0% or more. If the Si content is more than 5.0%, cold rolling manufacturability decreases significantly. The Si content is therefore preferably 5.0% or less. The Si content is more desirably in the range of 1.5% to 4.5%, in terms of iron loss and manufacturability.

Mn: 0.01% to 0.5%

Mn is a component that combines with S or Se to form MnSe or MnS and thus exerts an inhibitor effect. Mn also has an effect of improving hot workability during manufacture. If the Mn content is 0.01% or less, these effects cannot be achieved. If the Mn content is more than 0.5%, the primary recrystallized texture deteriorates and leads to lower magnetic property. The upper limit of the Mn content is therefore preferably 0.5%.

sol.Al: 0.001% to 0.050%

Al is a useful component that forms AlN in the steel and exerts an inhibitor effect as a second dispersion phase. If the Al content is less than 0.01%, a sufficient amount of precipitate cannot be ensured. If the Al content is more than 0.050%, AlN precipitates excessively after nitriding. This makes the grain growth inhibiting capability too high, which hampers secondary recrystallization even when the steel sheet is annealed to a high temperature. Even in the case where the Al content is less than 0.01%, $Si_3N_4$ not containing Al may precipitate depending on the balance with the amount of nitrogen. In the case of causing $Si_3N_4$ to function as an inhibitor, Al need not necessarily be contained in large quantity. Given that Al itself has a high affinity for oxygen, however, adding a trace amount of Al in steelmaking has an effect of suppressing property degradation by reducing the amount of oxygen dissolved in the steel and reducing oxides and inclusions in the steel. Thus, magnetic degradation can be suppressed by adding 0.001% or more acid-soluble Al.

N: 0.0010% to 0.020%

N is a component necessary to form AlN, as with Al. Nitrogen necessary as an inhibitor in secondary recrystallization can be supplied by nitriding in the subsequent step. If the N content is less than 0.0010%, however, crystal grain growth in the annealing step before the nitriding step is excessive, which may cause intergranular cracking in the cold rolling step or the like. If the N content is more than 0.020%, the steel sheet blisters or the like during slab heating. Therefore, the N content is preferably 0.0010% or more. The N content is preferably 0.020% or less.

In the case where AlN is actively used as an inhibitor, it is preferable to control the sol.Al content to 0.01% or more and control the N content to less than 14/26.98 of sol.Al. This allows AlN to be newly precipitated in the steel during nitriding.

In the case where only $Si_3N_4$ is actively used as an inhibitor, on the other hand, a preferable range of the N content is $\text{sol.Al} \times 14/26.98 \leq N \leq 80$ mass ppm, while controlling the sol.Al content to less than 0.01%. In the case where these ranges are not satisfied, for example, in the case where the steel sheet is manufactured from a slab having a composition of 0.09%-sol.Al and 0.002%-N, secondary recrystallization behavior may be unstable as AlN and $Si_3N_4$ are mixed.

One or two selected from S and Se: 0.002% to 0.040% in total

S and Se are each a useful element that combines with Mn or Cu to form MnSe, MnS, $Cu_{2-x}Se$, or $Cu_{2-x}S$ and thus exerts an inhibitor effect as a second dispersion phase in the steel. If the total content of S and Se is less than 0.002%, their effect is insufficient. If the total content of S and Se is more than 0.040%, not only dissolution during slab heating is incomplete, but also the product surface becomes defective. The total content of S and Se is therefore preferably in the range of 0.002% to 0.040% whether they are added singly or in combination.

While the important components in the slab have been described above, the following optional elements may be contained as appropriate as components for improving the magnetic property industrially more stably.

Ni: 0.005% to 1.50%

Ni has a function of improving the magnetic property by enhancing the uniformity of the hot rolled sheet texture. To do so, the Ni content is preferably 0.005% or more. If the Ni content is more than 1.50%, secondary recrystallization is difficult, and the magnetic property degrades. Accordingly, the Ni content is desirably 0.005% or more. The Ni content is desirably 1.50% or less.

Sn: 0.01% to 0.50%

Sn is a useful element that suppresses the nitriding or oxidation of the steel sheet during secondary recrystallization annealing and promotes the secondary recrystallization of crystal grains having favorable crystal orientation to improve the magnetic property. To do so, the Sn content is preferably 0.01% or more. If the Sn content is more than 0.50%, cold rolling manufacturability decreases. Accordingly, the Sn content is desirably 0.01% or more. The Sn content is desirably 0.50% or less.

Sb: 0.005% to 0.50%

Sb is a useful element that suppresses the nitriding or oxidation of the steel sheet during secondary recrystallization annealing and promotes the secondary recrystallization of crystal grains having favorable crystal orientation to effectively improve the magnetic property. To do so, the Sb content is preferably 0.005% or more. If the Sb content is more than 0.50%, cold rolling manufacturability decreases. Accordingly, the Sb content is desirably 0.005% or more. The Sb content is desirably 0.50% or less.

Cu: 0.01% to 0.50%

Cu has a function of suppressing the oxidation of the steel sheet during secondary recrystallization annealing and promoting the secondary recrystallization of crystal grains having favorable crystal orientation to effectively improve the magnetic property. To do so, the Cu content is preferably 0.01% or more. If the Cu content is more than 0.50%, hot rolling manufacturability decreases. Accordingly, the Cu content is desirably 0.01% or more. The Cu content is desirably 0.50% or less.

Cr: 0.01% to 1.50%

Cr has a function of stabilizing the formation of a forsterite coating. To do so, the Cr content is preferably 0.01% or more. If the Cr content is more than 1.50%, secondary recrystallization is difficult, and the magnetic property degrades. Accordingly, the Cr content is desirably 0.01% or more. The Cr content is desirably 1.50% or less.

P: 0.0050% to 0.50%

P has a function of stabilizing the formation of a forsterite coating. To do so, the P content is preferably 0.0050% or more. If the P content is more than 0.50%, cold rolling manufacturability decreases. Accordingly, the P content is desirably 0.0050% or more. The P content is desirably 0.50% or less.

Mo: 0.01% to 0.50%, Nb: 0.0005% to 0.0100%

Mo and Nb each have an effect of suppressing a scab after hot rolling by, for example, suppressing cracking due to a temperature change during slab heating. If the Mo content and the Nb content are each less than the aforementioned lower limit, its scab suppression effect is low. If the Mo content and the Nb content are each more than the aforementioned upper limit, iron loss degradation results when Mo or Nb remains in the steel sheet after final annealing by forming, for example, a carbide or a nitride. Accordingly, the Mo content and the Nb content are each desirably in the aforementioned range.

Ti: 0.0005% to 0.0100%, B: 0.0001% to 0.0100%, Bi: 0.0005% to 0.0100%

These components may each have an effect of functioning as an auxiliary inhibitor and stabilizing secondary recrystallization, by forming a precipitate when nitrided, segregating, or the like. If the contents of these components are each less than the aforementioned lower limit, its effect as an auxiliary inhibitor is low. If the contents of these components are each more than the aforementioned upper limit, the formed precipitate may remain even after purification and cause magnetic property degradation, or embrittle grain boundaries and degrade bend property.

The balance other than the aforementioned important elements and optional additional elements is Fe and incidental impurities. Regarding oxygen (O) as an impurity, if the amount of O is 50 mass ppm or more, it causes an inclusion such as a coarse oxide, and hampers the rolling step. As a result, the primary recrystallized texture becomes non-uniform, or the formed inclusion itself degrades the magnetic property. Accordingly, the amount of O is preferably limited to less than 50 mass ppm.

The following describes a manufacturing method according to the disclosure. A steel slab adjusted to the aforementioned preferable chemical composition range is, after or without being reheated, hot rolled into a hot rolled sheet. In the case of reheating the slab, the reheating temperature is desirably about 1000° C. or more and 1350° C. or less. Since nitriding treatment is performed before secondary recrystallization annealing to reinforce the inhibitor, fine precipitate dispersion by complete dissolution in the hot rolling step is not required. Hence, ultrahigh-temperature slab heating exceeding 1350° C. is not necessary.

It is, however, necessary to dissolve Al, N, Mn, S, and Se to some extent and disperse them during hot rolling so that the grain size will not be excessively coarsened in the annealing step before the nitriding. If the heating temperature is too low, the rolling temperature during hot rolling drops, which increases the rolling load and makes the rolling difficult. Accordingly, the reheating temperature is preferably 1000° C. or more.

Following this, the hot rolled sheet is optionally hot band annealed. Then, the hot rolled sheet is cold rolled once, or twice or more with intermediate annealing therebetween, to obtain a cold rolled sheet having final sheet thickness. The cold rolling may be performed at normal temperature. Alternatively, the cold rolling may be warm rolling with the steel sheet temperature being higher than normal temperature, e.g. about 250° C.

The cold rolled sheet is further primary recrystallization annealed, to obtain a primary recrystallization annealed sheet. The aim of the primary recrystallization annealing is to cause the primary recrystallization of the cold rolled sheet having rolled microstructure to adjust it to an optimal primary recrystallized grain size for secondary recrystallization. For this aim, the annealing temperature in the primary recrystallization annealing is desirably about 800° C. or more. The annealing temperature in the primary recrystallization annealing is desirably less than about 950° C. The annealing atmosphere may be a wet hydrogen nitrogen atmosphere or a wet hydrogen argon atmosphere, to perform decarburization annealing as well.

Nitriding treatment is performed on the cold rolled sheet during the primary recrystallization annealing, or on the primary recrystallization annealed sheet after the primary recrystallization annealing. The nitriding technique is not particularly limited, as long as the amount of nitrogen in the steel after the nitriding is 150 mass ppm or more and 1000 mass ppm or less. If the amount of nitrogen in the steel after the nitriding is less than 150 mass ppm, the TiN ratio in the base coating after the final annealing is low, and the advantageous effects according to the disclosure may not be achieved. The upper limit of the amount of nitrogen in the steel after the nitriding is 1000 mass ppm. If the nitriding treatment is performed so that the upper limit is exceeded, as a result of the inhibitor formed as secondary recrystallization inhibiting capability becoming too strong, a secondary recrystallization failure occurs, and favorable magnetic property is not obtained as iron loss $W_{17/50}$ increases to more than 1.0 W/kg. The amount of nitrogen in the steel after the nitriding is preferably 200 mass ppm or more. The amount of nitrogen in the steel after the nitriding is preferably 800 mass ppm or less. This is because a heat pattern suitable for the formation of a coating with a high TiN ratio is not realized outside this range.

As the nitriding treatment, for example, gas nitriding may be performed using $NH_3$ atmosphere gas in coil form, or transported strips may be nitrided continuously, as conventionally done. Salt bath nitriding or the like with higher nitriding ability than gas nitriding may also be used. Not only gas nitriding and salt bath nitriding but also many other nitriding techniques such as gas nitrocarburizing and plasma-based nitriding have been industrialized, and any of these techniques may be used.

An annealing separator is applied to the surface of the primary recrystallization annealed sheet after the primary recrystallization annealing and the nitriding treatment. A Ti compound that decomposes when the atmosphere and temperature conditions are met and can be safely handled in manufacture is contained in the annealing separator, to supply metal Ti in secondary recrystallization annealing (final annealing).

Typically, a Ti-containing compound tends to have high reactivity and be hard to be safely handled in manufacture. In the disclosure, Ti oxide or Ti silicide is preferably used. The Ti compound is contained in the range of 0.10 g/m$^2$ or more and 1.5 g/m$^2$ or less in Ti equivalent. If the Ti compound is less than 0.10 g/m$^2$ in Ti equivalent, a coating with a high TiN ratio cannot be formed on the steel sheet. If the Ti compound is more than 1.5 g/m$^2$ in Ti equivalent, metal Ti enters into the steel and forms TiN in the steel, which leads to degradation in final magnetic property.

The main ingredient of the annealing separator may be an adequate oxide whose melting point is higher than the secondary recrystallization annealing temperature such as alumina ($Al_2O_3$) or calcia (CaO), but the use of MgO is preferable. The term "main ingredient" in the disclosure means a component of more than 50 mass %.

Moreover, alkaline earth metal hydroxide is preferably added in the range of 2 g to 10 g with respect to 100 g of MgO. Various experiments show that the ability of forming a base coating with a high TiN ratio is low in the case of not using alkaline earth metal hydroxide or in the case of using alkaline earth metal sulfide/oxide or the like. Although the reason for this is not clear, we assume that alkaline earth metal hydroxide has any of an effect of retaining decomposed metal Ti on the steel sheet surface, an effect of forming an intermediate or the like with the Ti compound to change the decomposition temperature, and an effect of facilitating substitution to TiN.

In the disclosure, secondary recrystallization annealing (final annealing) is then performed. In the final annealing, soaking annealing of 20 hours or more is performed at a predetermined temperature of 800° C. to 950° C. in an oxidizing atmosphere of $PH_2O/PH_2$ of 0.05 or more. During the soaking annealing in this temperature range, it is preferable not to introduce hydrogen that leads to lower oxidizability.

It is also preferable to limit the amount of atmosphere gas introduced to 2500 mL/kg·h or less per steel sheet unit mass (kg) and per unit time (h). The soaking annealing itself has a favorable effect for secondary recrystallization when performed near the secondary recrystallization temperature. Accordingly, in the case where the secondary recrystallization temperature is known, more favorable magnetic property can be obtained by performing soaking at the temperature.

To obtain a base coating with a very high TiN ratio which is a feature according to the disclosure, the special condition is needed during the soaking treatment as mentioned above. This seems a little strange, given that TiN formation reaction is supposed to occur in the range where the annealing temperature is more than 1000° C. thermodynamically. Nevertheless, it is important to perform the soaking annealing in the temperature range of 800° C. to 950° C., as can be seen from the aforementioned verification experiment.

The atmosphere during the soaking annealing is an oxidizing atmosphere of $PH_2O/PH_2$ of 0.05 or more, and preferably an oxidizing atmosphere of $PH_2O/PH_2$ of 0.08 or more. It is typically known that atmospheric oxidizability during annealing increases by a trace amount of $H_2O$ generated from the annealing separator. In the verification experiment, however, soaking annealing is performed in a nitrogen-argon mixed atmosphere, so that $PH_2O/PH_2$ becomes "infinite" and a high oxidizing atmosphere emerges. Here, the steel sheet surface layer undergoes oxidation. This oxidation layer temporarily restrains, near the surface layer, nitrogen released out of the system as gas at the final nitrogen purification temperature, thus ensuring the reaction time with Ti.

Such an increase in atmospheric oxidizability derives from $H_2O$ supplied from the hydrated slurry. Therefore, in the case where gas containing water cannot be supplied from outside, it may be necessary to decrease the gas flow rate and suppress atmosphere exchange between steel sheets. In detail, the amount of gas introduced per steel sheet unit weight (kg) and per unit time (h) is preferably 2500 ml/kg·h or less. If the amount of gas introduced is more than this, it is difficult to obtain a base coating with a high TiN ratio. This does not apply in the case where gas containing water can be supplied.

Typically, $H_2$ gas is a useful gas to form a forsterite coating. However, $H_2$ gas leads to a decrease in atmospheric oxidizability ($PH_2O/PH_2$), and so is not suitable when performing the soaking annealing in this temperature range in the disclosure. There is a possibility that such atmospheric oxidizability facilitates the alteration of the Ti compound and makes the compound decomposition temperature an appropriate temperature.

The time of the soaking annealing at 800° C. to 950° C. is 20 hours or more. If the time is less than 20 hours, a desired base coating is not formed, and also secondary recrystallization is affected adversely. In terms of this, the time is preferably 30 hours or more. The upper limit of the time of the soaking annealing is not particularly limited. Soaking of more than 150 hours is not necessary for any of secondary recrystallization and Ti compound physical property change, and so the time may be 150 hours or less from the industrial point of view.

After the soaking annealing, the steel sheet is annealed for 5 hours or more in the temperature range of 1000° C. or more in a $H_2$-containing atmosphere. This is intended to directly reduce Ti oxide by hydrogen to form metal Ti. For Ti silicide, too, the atmosphere having the reduction effect is needed as oxidizability in the annealing is increased by $H_2O$ generated during the process. The decomposition temperature of the silicide is typically higher. In the disclosure, however, the decomposition temperature of the silicide is assumed to have been changed as a result of the soaking annealing of 800° C. to 950° C.

The atmosphere at 1000° C. or more is preferably an atmosphere containing 50 vol % or more $H_2$. If $H_2$ is less than 50 vol %, the aforementioned advantageous effects are insufficient. In terms of this, $H_2$ is preferably 70 vol % or more, and most preferably 100 vol %.

The annealing temperature profile in the temperature range of 1000° C. or more is not particularly limited, but the annealing time in this temperature range is 5 hours or more. If the annealing time is less than 5 hours, the decomposition of the Ti compound is insufficient, causing insufficient TiN formation. In terms of this, the annealing time is preferably 8 hours or more. The upper limit of the annealing time in this temperature range is not particularly limited, but is preferably 100 hours in terms of maintaining the coil shape.

After the secondary recrystallization annealing, a base coating with a high TiN ratio has been formed on the steel sheet surface. The base coating has the feature that the peak value PTiN of TiN (osbornite) observed in the range of $42°<2\theta<43°$ and the peak value $PMg_2SiO_4$ of $Mg_2SiO_4$ (forsterite) observed in the range of $35°<2\theta<36°$ are both more than 0 and satisfy the relationship $PTiN \geq PMg_2SiO_4$ in thin-film X-ray diffraction analysis, and has higher coating tension than a typically obtained forsterite coating. The base coating satisfying such conditions is likely to be found, from its appearance, to have near-gold color and not gray color specific to forsterite coatings.

In the case where the main ingredient of the annealing separator is not MgO, $Mg_2SiO_4$ is hardly formed. In such a case, the oxidation of the surface layer progresses, as a result of which $SiO_2$ is formed. The characteristic peak of $SiO_2$ (cristobalite) is observed in the range of $23°<2\theta<25°$. When this peak value $PSiO_2$ and PTiN satisfy the relationship $PTiN \geq PSiO_2$, the coating is closer to gold color than in the case where $Mg_2SiO_4$ is mixed, and has high coating tension as in the case where $Mg_2SiO_4$ is mixed.

Thus, in the disclosure, the base coating has the feature that the peak value PTiN of TiN (osbornite) observed in the range of $42°<2\theta<43°$ and the peak value $PSiO_2$ of $SiO_2$ (cristobalite) observed in the range of $23°<2\theta<25°$ are both more than 0 and satisfy the relationship $PTiN \geq PSiO_2$ in thin-film X-ray diffraction analysis, and has high coating tension as in the case where $Mg_2SiO_4$ is mixed.

An insulating coating may further be applied to the base coating and baked. The type of the insulating coating is not particularly limited, and may be any conventionally well-known insulating coating. For example, a method of applying an application liquid containing phosphate-chromate-colloidal silica described in JP S50-79442 A and JP S48-39338 A to the steel sheet and baking it at about 800° C. is preferable.

Moreover, flattening annealing may be performed to arrange the shape of the steel sheet. This flattening annealing may also serve as the insulating coating baking treatment.

EXAMPLES

Example 1

Each steel slab having the chemical composition containing Si: 3.13%, C: 0.05%, Mn: 0.06%, and S: 0.003%, containing Al and N in the ratio shown in Table 1, and, as the other components, containing Ni, Sn, Sb, Cu, Cr, P, Mo, Nb, and Ti in the ratio shown in Table 1 with the balance being Fe and incidental impurities was heated at 1200° C. for 40 minutes, and then hot rolled into a hot rolled sheet of 2.4 mm in sheet thickness. The hot rolled sheet was subjected to annealing of 1000° C.×1 minute, and cold rolled to a final sheet thickness of 0.27 mm. Each sample of 100 mm×400 mm in size was collected from the center part of the obtained cold rolled coil, and subjected to annealing serving both as primary recrystallization and decarburization in a lab, to obtain a primary recrystallization annealed sheet.

The primary recrystallization annealed sheet was subjected to nitriding treatment (batch treatment: salt bath nitriding treatment using salt mainly composed of cyanate, or gas nitriding treatment using mixed gas of $NH_3$ and $N_2$) under the condition shown in Table 1, to increase the amount of nitrogen in the steel as shown in Table 1. The amount of nitrogen in the steel was determined by chemical analysis for the overall sheet thickness. Five steel sheets were produced for each condition.

After this, an annealing separator that contained MgO as a main component and to which $TiO_2$ or $TiSi_2$ was added in the proportion shown in Table 1 in Ti equivalent and Sr(OH) was added in the proportion of 3 g with respect to 100 g of MgO was made into water slurry, and applied to the primary recrystallization annealed sheet and dried. Secondary recrystallization annealing was then performed under the following condition. The soaking time and soaking temperature in the temperature range of 800° C. to 950° C. are shown in Table 1. Moreover, the oxidizing atmosphere ($PH_2O/PH_2$) was controlled as shown in Table 1, by introducing water into the atmosphere. The amount of atmosphere gas introduced was 1500 mL/kg·h.

The atmosphere and annealing time in the temperature range of 1000° C. or more are shown in Table 1.

The obtained base coating was subjected to thin-film X-ray diffraction analysis by the same method as in the aforementioned verification experiment, to measure PTiN and $PMg_2SiO_4$. The sample was directly submitted to a single sheet tester (SST) to measure $W_{17/50}$ (iron loss when the steel sheet was excited to 1.7 T at 50 Hz). After the measurement, the coating on one side of the steel sheet was removed, and the magnitude of deflection of the steel sheet was evaluated. Table 1 shows the results. Since the tension applied to the steel sheet by the base coating differs depending on the composition of the base coating, the magnitude of deflection was compared between the conditions using the same annealing separator. In detail, conditions 1 to 6 were standardized with condition 1 being set to 100, conditions 7 to 13 were standardized with condition 7 being set to 100, and conditions 14 to 17 were standardized with condition 14 being set to 100. The average of the measurement values of five samples was used for evaluation.

TABLE 1

| | Slab component (Component before nitriding mass %) | | | Nitriding treatment | | | | Compound added to separator | |
|---|---|---|---|---|---|---|---|---|---|
| Condition | Al | N | Others | Treatment method | Treatment temperature | Treatment time | Amount of nitrogen | Composition | Ti equivalent |
| Condition 1 | 0.005 | 0.003 | Sb:0.02, Cr:0.03, P:0.05 | N/A | N/A | N/A | 30 ppm | $TiO_2$ | 0.25 g/m$^2$ |
| Condition 2 | 0.005 | 0.003 | Sb:0.02, Cr:0.03, P:0.05 | Gas nitriding | 490° C. | 5 min | 290 ppm | $TiO_2$ | 0.25 g/m$^2$ |
| Condition 3 | 0.005 | 0.003 | Sb:0.02, Cr:0.03, P:0.05 | Gas nitriding | 490° C. | 5 min | 290 ppm | $TiO_2$ | 0.25 g/m$^2$ |
| Condition 4 | 0.005 | 0.003 | Sb:0.02, Cr:0.03, P:0.05 | Gas nitriding | 490° C. | 5 min | 290 ppm | $TiO_2$ | 0.25 g/m$^2$ |
| Condition 5 | 0.005 | 0.003 | Sb:0.02, Cr:0.03, P:0.05 | Gas nitriding | 490° C. | 5 min | 290 ppm | $TiO_2$ | 0.25 g/m$^2$ |
| Condition 6 | 0.005 | 0.003 | Sb:0.02, Cr:0.03, P:0.05 | Gas nitriding | 490° C. | 5 min | 290 ppm | $TiO_2$ | 0.25 g/m$^2$ |
| Condition 7 | 0.0085 | 0.004 | Sn:0.01, Cu:0.05 | N/A | N/A | N/A | 40 ppm | $TiO_2$ | 0.15 g/m$^2$ |
| Condition 8 | 0.0085 | 0.004 | Sn:0.01, Cu:0.05 | Salt bath nitriding | 480° C. | 2 min | 120 ppm | $TiO_2$ | 0.15 g/m$^2$ |
| Condition 9 | 0.0085 | 0.004 | Sn:0.01, Cu:0.05 | Salt bath nitriding | 480° C. | 3 min | 180 ppm | $TiO_2$ | 0.15 g/m$^2$ |
| Condition 10 | 0.0085 | 0.004 | Sn:0.01, Cu:0.05 | Salt bath nitriding | 480° C. | 4 min | 240 ppm | $TiO_2$ | 0.15 g/m$^2$ |
| Condition 11 | 0.0085 | 0.004 | Sn:0.01, Cu:0.05 | Salt bath nitriding | 480° C. | 8 min | 600 ppm | $TiO_2$ | 0.15 g/m$^2$ |
| Condition 12 | 0.0085 | 0.004 | Sn:0.01, Cu:0.05 | Salt bath nitriding | 480° C. | 10 min | 900 ppm | $TiO_2$ | 0.15 g/m$^2$ |
| Condition 13 | 0.0085 | 0.004 | Sn:0.01, Cu:0.05 | Salt bath nitriding | 480° C. | 13 min | 1050 ppm | $TiO_2$ | 0.15 g/m$^2$ |
| Condition 14 | 0.0125 | 0.004 | — | N/A | N/A | N/A | 40 ppm | $TiSi_2$ | 0.30 g/m$^2$ |
| Condition 15 | 0.0125 | 0.004 | — | Gas nitriding | 590° C. | 2 min | 460 ppm | $TiSi_2$ | 0.30 g/m$^2$ |
| Condition 16 | 0.0125 | 0.004 | Ni:0.02 | Gas nitriding | 590° C. | 2 min | 460 ppm | $TiSi_2$ | 0.30 g/m$^2$ |
| Condition 17 | 0.0125 | 0.004 | Mo:0.05, Ti:0.002 | Gas nitriding | 590° C. | 2 min | 460 ppm | $TiSi_2$ | 0.30 g/m$^2$ |

TABLE 1-continued

| Condition | Soaking at 800-950° C. Soaking time | Soaking temperature | $PH_2O/PH_2$ | Annealing condition at 1000° C. or more | PTiN/ $PMg_2SiO_4$ | Ratio of magnitude of deflection of steel sheet | Iron loss (W/kg) | Remarks |
|---|---|---|---|---|---|---|---|---|
| Condition 1 | 30 h | 820 | 0.1 | Dry $H_2$ × 10 h | <0.3 | 100 | 0.975 | Comparative Example |
| Condition 2 | 15 h | 840 | 0.1 | Dry $H_2$ × 10 h | <0.3 | 110 | 0.969 | Comparative Example |
| Condition 3 | 30 h | 840 | 0.03 | Dry $H_2$ × 10 h | <0.3 | 106 | 0.970 | Comparative Example |
| Condition 4 | 30 h | 840 | 0.1 | Dry $H_2$ × 4 h | <0.3 | 97 | 0.968 | Comparative Example |
| Condition 5 | 30 h | 840 | 0.1 | Dry $N_2$ × 10 h | <0.3 | 90 | 0.965 | Comparative Example |
| Condition 6 | 30 h | 840 | 0.1 | Dry $H_2$ × 10 h | 1.4 | 175 | 0.959 | Example |
| Condition 7 | 40 h | 830 | 0.1 | Dry $H_2$ × 10 h | <0.3 | 100 | 0.973 | Comparative Example |
| Condition 8 | 40 h | 850 | 0.1 | Dry $H_2$ × 10 h | 0.8 | 120 | 0.966 | Comparative Example |
| Condition 9 | 40 h | 860 | 0.1 | Dry $H_2$ × 10 h | 1 | 155 | 0.962 | Example |
| Condition 10 | 40 h | 860 | 0.1 | Dry $H_2$ × 10 h | 1.6 | 205 | 0.958 | Example |
| Condition 11 | 40 h | 870 | 0.1 | Dry $H_2$ × 10 h | 1.5 | 180 | 0.957 | Example |
| Condition 12 | 40 h | 880 | 0.1 | Dry $H_2$ × 10 h | 1 | 125 | 0.961 | Example |
| Condition 13 | 40 h | 890 | 0.1 | Dry $H_2$ × 10 h | 0.9 | 105 | 1.544 | Comparative Example |
| Condition 14 | 40 h | 840 | 0.1 | Dry $H_2$ × 10 h | <0.3 | 100 | 0.982 | Comparative Example |
| Condition 15 | 40 h | 870 | 0.1 | Dry $H_2$ × 10 h | 1.4 | 160 | 0.962 | Example |
| Condition 16 | 40 h | 870 | 0.1 | Dry $H_2$ × 10 h | 1.4 | 165 | 0.958 | Example |
| Condition 17 | 40 h | 870 | 0.1 | Dry $H_2$ × 10 h | 1.4 | 160 | 0.957 | Example |

As shown in Table 1, Examples had high coating tension and excellent iron loss property as compared with Comparative Examples.

Example 2

Each steel slab having the chemical composition containing Si: 3.2%, C: 0.03%, Mn: 0.08%, S: 0.001%, Se: 0.003%, Al: 0.016%, N: 0.004%, and Bi: 0.001% with the balance being Fe and incidental impurities was heated at 1180° C. for 50 minutes, and then hot rolled into a hot rolled sheet of 2.0 mm in sheet thickness. The hot rolled sheet was subjected to annealing of 1050° C.×1 minute, and cold rolled to a final sheet thickness of 0.23 mm with intermediate annealing of 1080° C. in between. Each sample of 100 mm×400 mm in size was collected from the center part of the obtained cold rolled coil, and subjected to annealing serving both as primary recrystallization and decarburization in the lab, to obtain a primary recrystallization annealed sheet.

The primary recrystallization annealed sheet was subjected to gas nitriding treatment using mixed gas of $NH_3$, $H_2$, and $N_2$, to control the amount of nitrogen in the steel to 350 mass ppm.

After this, an annealing separator containing a Ti compound in the proportion shown in Table 2 and mainly composed of $Al_2O_3$ containing an appropriate amount of $Ca(OH)_2$ was applied to the primary recrystallization annealed sheet and dried. Secondary recrystallization annealing was then performed under the following condition. First, soaking annealing of 840° C. and 30 hours was performed in an atmosphere ($PH_2O/PH_2=\infty$) with a mixture ratio of $N_2$ and Ar of 1:4, with the amount of gas introduced as shown in Table 2.

Following this, in the temperature range of 1000° C. or more, annealing of 15 hours was performed in a $H_2$ atmosphere.

The obtained base coating was subjected to thin-film X-ray diffraction analysis by the same method as in the aforementioned verification experiment, to measure PTiN and $PMg_2SiO_4$. Assuming that the tension property of each formed coating differed due to the difference in the annealing separator composition, no evaluation was made on the magnitude of deflection. The sample was directly submitted to a single sheet tester (SST) to measure $W_{17/50}$ (iron loss when the steel sheet was excited to 1.7 T at 50 Hz). The average of the measurement values of five samples of the same condition was used for evaluation. Table 2 shows the results.

TABLE 2

| Condition | Compound added to separator Composition | Ti equivalent | Gas flow rate during soaking | PTiN/ $PSiO_2$ | Iron loss (W/kg) | Remarks |
|---|---|---|---|---|---|---|
| Condition 1 | $TiO_2$ | 0.08 g/m$^2$ | 1000 ml/kg · h | 0.7 | 0.921 | Comparative Example |
| Condition 2 | $TiO_2$ | 0.12 g/m$^2$ | 1000 ml/kg · h | 1.5 | 0.915 | Example |
| Condition 3 | $TiO_2$ | 0.30 g/m$^2$ | 1000 ml/kg · h | 2.2 | 0.911 | Example |
| Condition 4 | $TiO_2$ | 0.80 g/m$^2$ | 2000 ml/kg · h | 1.7 | 0.916 | Example |
| Condition 5 | $TiO_2$ | 1.60 g/m$^2$ | 2600 ml/kg · h | 0.9 | 0.944 | Comparative Example |

As shown in Table 2, Examples had excellent iron loss property as compared with Comparative Examples.

Example 3

Each steel slab having the chemical composition containing Si: 3.4%, C: 0.04%, Mn: 0.03%, S: 0.01%, Al: 0.006%, and N: 0.004% with the balance being Fe and incidental impurities was heated at 1200° C. for 60 minutes, and then hot rolled into a hot rolled sheet of 2.0 mm in sheet thickness. The hot rolled sheet was subjected to annealing of 1050° C.×2 minutes, and then cold rolled into a cold rolled sheet having a final sheet thickness of 0.23 mm. The cold rolled sheet was subjected to annealing serving both as primary recrystallization and decarburization. Each sample (primary recrystallization annealed sheet) of 100 mm×400 mm in size was collected from the center part of the obtained coil. The primary recrystallization annealed sheet was subjected to nitriding treatment in an $NH_3$ gas atmosphere until the amount of nitrogen in the steel reached 300 mass ppm.

After this, in the lab, an annealing separator that contained MgO as a main ingredient and to which $Sr(OH)_2$ was added in the proportion of 2 g with respect to 100 g of MgO and a Ti compound was added in the proportion shown in Table 3 was applied to the primary recrystallization annealed sheet and dried. Secondary recrystallization annealing was then performed under the following condition. The soaking time and soaking temperature in the temperature range of 800° C. to 950° C. are shown in Table 3. The oxidizing atmosphere ($PH_2O/PH_2$) and the amount of atmosphere gas introduced are shown in Table 3.

Following this, heating was performed from 1000° C. to 1180° C. for 6 hours, and soaking of 5 hours was performed at 1180° C. In the temperature range of 1000° C. or more, an atmosphere containing 50 vol % or more $H_2$ was used.

The obtained base coating was subjected to thin-film X-ray diffraction analysis by the same method as in the aforementioned verification experiment, to measure PTiN and $PMg_2SiO_4$. After the measurement, the coating on one side of the steel sheet was removed, and the magnitude of deflection of the steel sheet was evaluated. Regarding the magnitude of deflection, conditions 1 to 4 were standardized with condition 1 being set to 100, and conditions 5 to 8 were standardized with condition 5 being set to 100. The average of the measurement values of five samples was used for evaluation. Table 3 shows the results.

As shown in Table 3, Examples had high coating tension as compared with Comparative Examples.

The invention claimed is:

1. A grain-oriented electrical steel sheet comprising:

a base coating having a peak value PTiN of TiN in the form of osbornite, observed in a range of $42°<2\theta<43°$ and a peak value $PMg_2SiO_4$ of $Mg_2SiO_4$ in the form of forsterite, observed in a range of $35°<2\theta<36°$ of both more than 0 and satisfying a relationship $PTiN \geq PMg_2SiO_4$, in thin-film X-ray diffraction analysis; and an iron loss $W_{17/50}$ of 1.0 W/kg or less.

2. A method of manufacturing the grain-oriented electrical steel sheet according to claim 1, comprising:

hot rolling a steel slab to obtain a hot rolled sheet, the steel slab having a chemical composition containing, in mass %, C: 0.001% to 0.10%, Si: 1.0% to 5.0%, Mn: 0.01% to 0.5%, one or two selected from S and Se: 0.002% to 0.040% in total, sol.Al: 0.001% to 0.050%, and N: 0.0010% to 0.020%, with a balance being Fe and incidental impurities;

optionally hot band annealing the hot rolled sheet;

thereafter cold rolling the hot rolled sheet either once, or twice or more with intermediate annealing performed therebetween, to obtain a cold rolled sheet having a final sheet thickness;

thereafter primary recrystallization annealing the cold rolled sheet, to obtain a primary recrystallization annealed sheet;

performing nitriding treatment on the cold rolled sheet during the primary recrystallization annealing or on the primary recrystallization annealed sheet after the primary recrystallization annealing; and thereafter applying an annealing separator to the primary recrystallization annealed sheet after the nitriding treatment, and secondary recrystallization annealing the primary recrystallization annealed sheet, wherein an amount of nitrogen in steel after the nitriding treatment is 150 mass ppm or more and 1000 mass ppm or less, the annealing separator contains MgO as a main ingredient, and contains Ti oxide or Ti silicide in a range of 0.10 $g/m^2$ or more and 1.5 $g/m^2$ or less in Ti mass equivalent, and in the secondary recrystallization annealing, soaking annealing of 20 hours or more is performed at a predetermined temperature of 800° C. to 950° C. in an oxidizing atmosphere of $PH_2O/PH_2$ of 0.05 or more,

TABLE 3

| | Compound added to separator | | Soaking condition at less than 1000° C. | | | | | | Ratio of magnitude | |
|---|---|---|---|---|---|---|---|---|---|---|
| Condition | Composition | Ti equivalent | Soaking time | Soaking temperature | Gas used | $PH_2O/PH_2$ | Gas flow rate | $PTiN/PMg_2SiO_4$ | of deflection of steel sheet | Remarks |
| Condition 1 | $TiO_2$ | 0.25 $g/m^2$ | 30 hr | 780° C. | Dry-Ar | ∞ | 1000 ml/kg · h | <0.3 | 100 | Comparative Example |
| Condition 2 | $TiO_2$ | 0.25 $g/m^2$ | 30 hr | 800° C. | Dry-Ar | ∞ | 1000 ml/kg · h | 1.6 | 200 | Example |
| Condition 3 | $TiO_2$ | 0.25 $g/m^2$ | 30 hr | 850° C. | Dry-$H_2$,$N_2$ | <0.01 | 2700 ml/kg · h | 0.4 | 110 | Comparative Example |
| Condition 4 | $TiO_2$ | 0.25 $g/m^2$ | 30 hr | 850° C. | Dry-$H_2$,$N_2$ | 0.08 | 300 ml/kg · h | 1.7 | 220 | Example |
| Condition 5 | $TiO_2$ | 0.40 $g/m^2$ | 40 hr | 780° C. | Dry-$H_2$ | <0.01 | 2500 ml/kg · h | <0.3 | 100 | Comparative Example |
| Condition 6 | $TiO_2$ | 0.40 $g/m^2$ | 40 hr | 850° C. | Wet-$H_2$,$N_2$ | 0.08 | 2700 ml/kg · h | 1.7 | 220 | Example |
| Condition 8 | $TiO_2$ | 0.40 $g/m^2$ | 40 hr | 950° C. | Dry-N2.Ar | ∞ | 2000 ml/kg · h | 1.2 | 150 | Example |
| Condition 9 | $TiO_2$ | 0.40 $g/m^2$ | 40 hr | 980° C. | Dry-$H_2$,$N_2$ | 0.1 | 2000 ml/kg · h | 0.8 | 120 | Comparative Example |

and then annealing of 5 hours or more is performed in a temperature range of 1000° C. or more in a $H_2$-containng atmosphere.

3. The method of manufacturing the grain-oriented electrical steel sheet according to claim 2, wherein the chemical composition of the steel slab further contains, in mass %, one or more selected from Ni: 0.005% to 1.50%, Sn: 0.01% to 0.50%, Sb: 0.005% to 0.50%, Cu: 0.01% to 0.50%, Cr: 0.01% to 1.50%, P: 0.0050% to 0.50%, Mo: 0.01% to 0.50%, Nb: 0.0005% to 0.0100%, Ti: 0.0005% to 0.0100%, B: 0.0001% to 0.0100%, and Bi: 0.0005% to 0.0100%.

4. A method of manufacturing the grain-oriented electrical steel sheet according to claim 1, comprising:

hot rolling a steel slab to obtain a hot rolled sheet, the steel slab having a chemical composition containing, in mass %, C: 0.001% to 0.10%, Si: 1.0% to 5.0%, Mn: 0.01% to 0.5%, one or two selected from S and Se: 0.002% to 0.040% in total, sol.Al: 0.001% to 0.050%, and N: 0.0010% to 0.020%, with a balance being Fe and incidental impurities;

optionally hot band annealing the hot rolled sheet;

thereafter cold rolling the hot rolled sheet either once, or twice or more with intermediate annealing performed therebetween, to obtain a cold rolled sheet having a final sheet thickness;

thereafter primary recrystallization annealing the cold rolled sheet, to obtain a primary recrystallization annealed sheet;

performing nitriding treatment on the cold rolled sheet during the primary recrystallization annealing or on the primary recrystallization annealed sheet after the primary recrystallization annealing; and thereafter applying an annealing separator to the primary recrystallization annealed sheet after the nitriding treatment, and secondary recrystallization annealing the primary recrystallization annealed sheet, wherein an amount of nitrogen in steel after the nitriding treatment is 150 mass ppm or more and 1000 mass ppm or less, the annealing separator contains a Ti compound in a range of 0.10 $g/m^2$ or more and 1.5 $g/m^2$ or less in Ti mass equivalent, and in the secondary recrystallization annealing, soaking annealing of 20 hours or more is performed at a predetermined temperature of 800° C. to 950° C. in an oxidizing atmosphere of $PH_2O/PH_2$ of 0.05 or more, and then annealing of 5 hours or more is performed in a temperature range of 1000° C. or more in a $H_2$-containing atmosphere.

5. The method of manufacturing the grain-oriented electrical steel sheet according to claim 4, wherein the chemical composition of the steel slab further contains, in mass %, one or more selected from Ni: 0.005% to 1.50%, Sn: 0.01% to 0.50%, Sb: 0.005% to 0.50%, Cu: 0.01% to 0.50%, Cr: 0.01% to 1.50%, P: 0.0050% to 0.50%, Mo: 0.01% to 0.50%, Nb: 0.0005% to 0.0100%, Ti: 0.0005% to 0.0100%, B: 0.0001% to 0.0100%, and Bi: 0.0005% to 0.0100%.

* * * * *